United States Patent [19]

Martin

[11] Patent Number: 4,489,958

[45] Date of Patent: Dec. 25, 1984

[54] PERSONAL TIME MANAGEMENT INSTRUMENT

[76] Inventor: Alain P. Martin, 79 Fentiman Ave., Ottawa, Ontario K1S 0T7, Canada

[21] Appl. No.: 416,095

[22] Filed: Sep. 8, 1982

[51] Int. Cl.[3] ..... B42D 5/04; B42D 15/00

[52] U.S. Cl. ..... 283/3; 283/66 R

[58] Field of Search ..... 283/48 R, 48 A, 66 R, 283/55, 1 A–2, 3, 418 A, 49, 50, 51, 66 A, 900; 282/27 R, 29 A, 29 B, 29 C

[56] References Cited

U.S. PATENT DOCUMENTS

| | | | |
|---|---|---|---|
| 460,518 | 10/1891 | Barrett | 283/48 A |
| 1,050,001 | 1/1913 | Cowing | 283/48 A |
| 1,227,653 | 5/1917 | Penewill | 283/48 A |
| 1,253,714 | 1/1918 | Otis | 283/3 |
| 1,408,508 | 3/1922 | Horn, Jr. | 283/48 R |

FOREIGN PATENT DOCUMENTS

| | | | |
|---|---|---|---|
| 645203 | 7/1962 | Canada | 283/66 R |
| 805317 | 11/1936 | France | 283/2 |
| 49987 | 11/1910 | Switzerland | 283/2 |

*Primary Examiner*—Robert L. Spruill
*Assistant Examiner*—Paul M. Heyrana, Sr.
*Attorney, Agent, or Firm*—Kenyon & Kenyon

[57] ABSTRACT

A sheet for personal time management is provided with an activity section and a calendar section to provide an entire week's scheduled activities over the same working hours each day. A plurality of such sheets can be incorporated into a book so as to provide a permanent record on a day-to-day basis of what is planned to be done and what has been done. The activity section has a wide vertical column with horizontal lines to define spaces in which an activity may be written. The calendar section has vertical subcolumns, one of which designates each day in the time period, while the other contains blocks which are subdivided to designate sequential times in a day.

11 Claims, 2 Drawing Figures

PERSONAL TIME MANAGEMENT INSTRUMENT

BACKGROUND OF THE INVENTION

The present invention relates to a time management system, and more particularly to a sheet or series of sheets for personal time management over a number of days.

Daily "diaries" or day planners for business purposes come in a wide variety of forms. Most consist however of pages having sections setting out each day in a calendar year, each such daily section being subdivided into portions representing times within the day. A particular activity scheduled for a particular time in a particular day is entered onto the relevant sheet in the relevant portion. A change in scheduling of that activity to another time or another day necessitates rewriting the planned activity in the space corresponding to the new time, and crossing off or erasing that activity from the section represented by the original time planned for it. There have been few improvements or deviations from such a standard format of time management instruments over the years.

In some known forms of time management planning diaries, individual sheets are set up on a weekly basis, with sections for each day and for times within each day, in which to write scheduled activities such as meetings, appointments and the like. In addition, on each such sheet representing a week's time period, there may be provided a section apart from the day sections, in which may be written activities scheduled generally for that week but not having a particular planned time of occurrence. There may be a number of sections identified by headings such as "PHONE", "WRITE", "SEE", "DO", and the like. One such diary is described and illustrated in Canadian Pat. No. 645,203 of Beltrami issued July 24, 1962.

Such known time management instruments are intended primarily as appointment books and, in some instances, as combined appointment diary and work planner (listing work to be done) or appointment diary and time log (as to what in fact was done). Usually a day planner or appointment book does not suitably serve as a time log—another set of sheets is normally used in conjunction with such records, the user setting out at the end of each day or week his accomplishments for that particular week.

Other calendar type diaries of general background interest include Canadian Pat. No. 184,972 of Robichon issued June 18, 1918, U.S. Pat. No. 4,218,077 of Ember issued Aug. 19, 1980 and U.S. Pat. No. 4,319,771 of Yglesias issued Mar. 16, 1982.

Other references of general background interest, not relating to personal time management instruments, but relating generally to time scheduling of actions or events, are U.S. Pat. No. 2,295,102 of Fisher issued Sept. 8, 1942 and U.S. Pat. No. 3,785,681 of Jackowitz issued Jan. 15, 1974. Neither of these references teaches nor suggests a format for a sheet which would be useful for daily time management and organization by an individual.

It is thus an object of the present invention to provide a time management system for an individual which will combine on a single page an appointment agenda, a work plan and a time log for that individual over a period of time. It is a further object of the present invention to provide an appointment planning sheet in which removal or transfer of information relating to the appointment as a result of changes in time of that appointment are minimized. It is a further object of the present invention to provide a readable, comprehensive time management instrument which minimizes the need for writing and maximizes the space for writing of intended activities.

SUMMARY OF THE INVENTION

According to the present invention there is provided a sheet for personal time management for a time period consisting of a plurality of days. The sheet comprises an activity section comprising a wide vertical column divided into spaces by a series of horizontal lines, in each of which activity spaces and activity may be written. As well a calendar section is provided comprising a vertical column extending the length of and positioned beside the activity section. The calendar section column is subdivided through its length into adjacent vertical subcolumns, one such subcolumn designated for each day in the time period. The horizontal lines from the activity section extend through the subcolumns and thereby provide a grid unit in each subcolumn particular to each activity space. Further columns may be provided extending the length of and positioned beside the activity section, with the horizontal lines from the activity section extending through such further columns, such columns being designated to receive an indication of the priority or urgency of the associated activity or an indication of a person to whom the corresponding activity has been delegated. In a preferred embodiment the calendar section further comprises a series of blocks, one block representing each day in the time period, each block being subdivided into a series of spaces marked to sequentially designate times in a day and one such space in each block representing a different one of such times. Several sheets, for example, covering a time period of a year, may be assembled in book form in a preferred embodiment of the invention.

The time management sheet according to the present invention enables rearrangement of activities planned during the time period without having to cancel or rearrange the written indication of that activity from one space to another, and provides an attractive, comprehensive and efficient layout for a personal time management schedule. The layout of the sheets according to the present invention provides for more capacity for writing, since, because of applicant's layout, the sheets do not have to provide space in each time section in each day to receive information related to a potential activity. The amount of writing required to identify the nature of a particular activity may be significantly shortened according to the present invention. Applicant's layout readily lends itself to provide a comprehensive, compact combined appointment agenda, work plan and time log on each sheet, in a manner as will be described in more detail hereinafter. The time log of actual work done can be maintained, without duplication of effort, on applicant's sheet with the schedule of planned work.

BRIEF DESCRIPTION OF THE DRAWINGS

Other objects and advantages of the invention will become apparent upon reading the following detailed description taken in conjunction with the accompanying drawings wherein.

While the invention will be described in connection with an example embodiment, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

Figure 1:
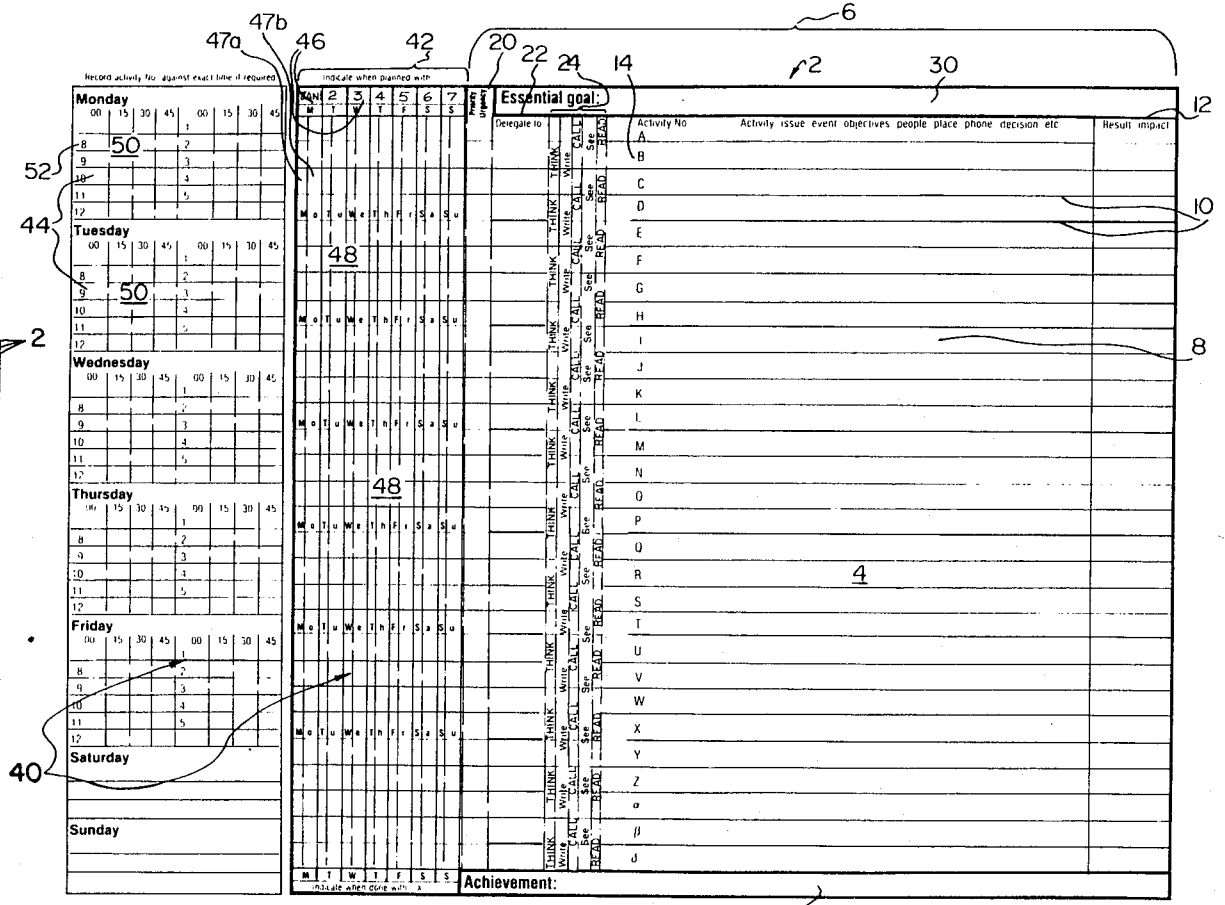
FIG. 1 illustrates a plan view of a time management sheet according to the invention.

Turning to FIG. 1 there is shown a sheet 2 for personal time management according to the present invention. The illustrated sheet covers a period of time of one week, although it will be understood that any desired time period may be covered on a single sheet with appropriate modifications to the layout. The sheet is divided generally into an activity section 4 comprising a wide vertical column 6 divided into spaces 8 by a series of horizontal lines 10. Into each of these activity spaces 8 may be written an intended activity, appointment, action or the like. To the right, in activity section 4, is a column 12 designated to receive an indication of the result or outcome of each such activity.

In the embodiment illustrated, each indicated activity space 8 is designated with a code letter 14 to be used as will be discussed shortly. Also, to facilitate use of the activity section 4 and minimize the writing required, priority column 20, delegation column 22 and activity designation columns 24 are provided as indicated. The user may indicate the priority of the item listed in activity space 8 in the corresponding portion of priority column 20. He may indicate in the corresponding portion of delegation column 22 a person to whom an activity set out in the corresponding activity space 8 is delegated. He may check the manner in which the activity set out in corresponding activity space 8 is to be acted upon by appropriately noting one of the columns of activity designation columns 24. In this latter instance, while "THINK", "WRITE", "CALL", "SEE", and "READ" designations illustrated in these columns, it will be obvious to one skilled in the art that other activity designations may be included with, or used to replace some or all of, the illustrated activity designation columns 24. Alternatively it may be desired to relate the activities set out in activity space 8 to a particular objective of the user, and activity designation columns 24 might then be replaced with designations such as "CORPORATE", "PERSONAL", "HEALTH AND FITNESS", "FRIENDS", "COMMUNITY", "TRAINING", "COACHING ASSOCIATES", "CAREER", "TRAVEL", "LEISURE", "SECURITY", "INFLEXIBLE OBLIGATIONS", and the like.

Finally, in activity section 4 is illustrated a section 30 at the top intended to receive a designation of a goal or goals for the week in question and section 32 at the bottom, for setting out a particular achievement or achievements for the week in question.

It will be understood that with activity section 4, as with other sections of the personal time management sheet according to the present invention, the format may be adopted to suit particular circumstances and layout requirements. Thus, activity code numbers may be unnecessary or may be altered to take different forms, result, priority, delegation and activity designation columns 12, 20, 22 and 24 respectively, may be rearranged or used or not used as required or desired, and goal and achievement sections 30 and 32 may or may not be used as required or desired.

To the left of activity section 4 there is provided a calendar section 40 made up of two parts, one containing a vertical column 42 extending the length of and positioned beside the activity section, and the other containing a series of blocks 44, one block representing each day in the time period to which the sheet applies. Column 42 is subdivided through its length into adjacent vertical subcolumns 46, one such subcolumn being designated for each day in the time period. The subcolumns 46 are also further divided into portions 47*a* and 47*b* directed respectively to morning and afternoon periods of the day. It will be noted that lines 10 from activity section 4 extend through subcolumns 46 and thereby provide a grid unit 48 in each subcolumn particular to each activity space (i.e. for each day in the time period there is a grid unit corresponding to each of the subcolumns 46 and each of the activity spaces 8).

Blocks 44, representing Monday to Friday in the time period, are subdivided into a series of spaces 50, marked by time designations 52 as indicated to sequentially designate times in a day. One such space 50 in each block 44 represents a different one of such times. It will be noted that for those blocks 44 designating Saturday and Sunday, the blocks are not subdivided in a manner so as to show times in those days.

Figure 2:
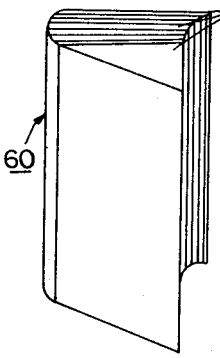
FIG. 2 illustrates a book containing a plurality of time management sheets in accordance with the invention.

Referring to FIG. 2, it will be understood that fifty-two of such weekly sheets 2, or any desired number of such sheets to cover a particular time period, may be bound into a book 60 to provide a time management instrument covering a year or other period of time.

As an example of the use and operation of these sheets, at the beginning of a particular week in question, a user may set out the planned activities of which he has before him for that particular week. As well, he will have already appearing on that sheet any previously arranged appointments. If, for example, there is a meeting with Henry Adams on Tuesday morning of that week at 9:15, this appointment is/or has been recorded simply by noting Henry Adams' name in a work activity space 8, ticking the "SEE" column in the activity designation columns 24, indicating with a "/" or other appropriate notation on the same line under the Tuesday morning segment of the subcolumn 46 representing Tuesday in the column 42, and writing the corresponding activity code 14 ("B" in this example) in the calendar block 44 representing Tuesday, in the 9:15 space 50. If, subsequently, this appointment were changed to Wednesday afternoon at 2:15, instead of having to erase Henry Adams' name from the activity section 8 and move it to a different location, the user now merely places another "/" notation in the Wednesday afternoon subcolumn 46, and moves the "B" code designation from the Tuesday calendar block 44 to the Wednesday calendar block 44 at 2:15. When an activity such as a meeting is carried out, if "/" is the designation used to indicate *intended* activities in subcolumns 46, then another stroke through that designation to make an "X" may be used to indicate that that activity has been completed.

Many advantages which are relatively significant in documentation for time management, are achieved according to the present invention. For instance, it can be readily appreciated through the preceding example, that the need for writing is considerably lessened. This is achieved through the use of activity designation columns 24, the integration of lines 10 between activity section 4 and columns 46 of calendar section 41, and the use of code letters, instead of full activity designations, in calendar blocks 44. As well, as has been previously indicated several times, activity write ups in spaces 8 do not have to be crossed off or transferred in a particular week if, for example, the designated time for that activity is changed to another time within the time period covered by that particular sheet. The basic information remains. Merely the abbreviated information appearing on calendar section 41 is changed.

Moreover, the format according to the present invention provides more capacity for writing, if required, since activity designation spaces 8 are significantly larger than would be otherwise permitted in a traditional work sheet, of the same size, in which the activity spaces had to be incorporated with the time designation spaces 50 in calendar blocks 44.

Applicant's layout also permits greater information to be concentrated, in meaningful fashion, on a single page. A completed sheet, at the end of a week, may be kept as a log of completed activities for that week, as well as an indication of intended, but uncompleted activities for the week. Moreover, if, at the beginning of a week, the user has set out in sequence those activities which he has ahead of him for that week, and draws a line immediately after the last such item entered in activity spaces 8, then by recording any new activity items which arise in the course of that week below that line, at the end of the week he has a record of new activities arising during the course of the week. In this way he has a simple way of assessing old or planned work in a week with new or unplanned work.

It will be understood that, while not illustrated, when a series of sheets 2 are included to make up, say, a yearly diary, appropriately formatted sheets may also be included in such a book directed towards monthly and yearly projects and objectives and their timing.

Thus it is apparent that there has been provided in accordance with the invention a personal time management instrument that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention is:

1. A single sheet for personal time management for a time period consisting of a plurality of days comprising:

(a) an activity section comprising a wide vertical column divided into spaces by a series of horizontal lines, in each of which spaces an activity may be written; and (b) a calendar section comprising a vertical column extending the length of and positioned beside the activity section, the calendar section column being subdivided into adjacent vertical subcolumns, one such subcolumn designated for each day in the time period, the horizontal lines from the activity section extending through the subcolumns to thereby provide a grid unit in each subcolumn particular to each activity space, said calendar section further comprising a series of blocks, one block representing each day in the time period, each block as required being subdivided into a series of spaces marked to sequentially designate times in a day, one such space in each block representing a different one of such times.

2. A sheet according to claim 1 wherein each activity space is identified by its own unique code reference.

3. A sheet according to claim 1 wherein the activity section is further provided with a plurality of adjacent columns extending the length of the section, each column being identified with a different specific activity designation.

4. A sheet according to claim 1 or 2 comprising a further column extending the length of and positioned beside the activity section, the horizontal lines from the activity section extending through this column, this column being designated to receive an indication of the priority or urgency of the associated activity on each line.

5. A sheet according to claim 1 or 2 comprising a further column extending the length of and positioned beside the activity section, the horizontal lines from the activity section extending through this column, this column being designated to receive an indication of a person to whom the associated activity on such line is delegated.

6. A sheet according to claim 1 or 2 wherein the time period is seven days.

7. A sheet according to claim 1 wherein the time period is seven days, the sheet further comprising a section or sections in which goals and achievements for those days may be written.

8. A sheet according to claim 1 wherein the time interval subcolumns are each are subdivided into morning and afternoon portions.

9. A sheet according to claim 1 wherein the activity section is further provided with a column extending the length of the section and designated to receive an indication of the result or outcome of each activity.

10. A book for personal time management for a time period consisting of a plurality of days comprising a plurality of sheets assembled in book form, each said sheet including (a) an activity section comprising a wide vertical column divided into spaces by a series of horizontal lines, in each of which spaces an activity may be written; and (b) a calendar section comprising a vertical column extending the length of and positioned beside the activity section, the calendar section column being subdivided into adjacent vertical subcolumns, one such subcolumn designated for each day in the time period, the horizontal lines from the activity section extending through the subcolumns to thereby provide a grid unit in each subcolumn particular to each activity space, said calendar section further comprising a series of blocks, one block representing each day in the time period, each block as required being subdivided into a series of spaces marked to sequentially designate times in a day, one such space in each block representing a different one of such times.

11. A book according to claim 10 wherein each sheet is for a time period consisting of a week, and said sheets are sufficient in number for a time period of at least a year.

* * * * *